United States Patent [19]

Schoolman et al.

[11] 4,446,654

[45] May 8, 1984

[54] COUNTERBALANCE LOCK MECHANISM FOR A WINDOW ASSEMBLY

[75] Inventors: William K. Schoolman, Wyatt; George A. Griman, Osceola; Frank D. Andrews, Bremen, all of Ind.

[73] Assignee: Mastic Corporation, South Bend, Ind.

[21] Appl. No.: 427,973

[22] Filed: Sep. 29, 1982

[51] Int. Cl.[3] ..... E05D 15/22

[52] U.S. Cl. ..... 49/181; 49/446; 49/453

[58] Field of Search ..... 49/181, 445, 446, 453

[56] References Cited

U.S. PATENT DOCUMENTS

| | | | |
|---|---|---|---|
| 528,333 | 10/1894 | Massalski | 49/446 |
| 895,162 | 8/1908 | Cooper | 49/181 X |
| 3,387,408 | 6/1968 | Narculli | 49/446 |
| 4,079,549 | 3/1978 | Wood | 49/181 |

*Primary Examiner*—Kenneth Downey

*Attorney, Agent, or Firm*—James D. Hall

[57] ABSTRACT

An improved counterbalance lock mechanism for a window assembly which includes a manually turned lock pin fitted within a stationary housing member located in the window jamb. The lock pin may be rotated into a first position subjecting a slide block to the influence of the mechanism and a second position which isolates the slide block from the counterbalancing effect.

3 Claims, 4 Drawing Figures

COUNTERBALANCE LOCK MECHANISM FOR A WINDOW ASSEMBLY

SUMMARY OF THE INVENTION

This invention relates to an improved counterbalancing mechanism for a window assembly.

Counterbalancing mechanisms are well known in the window arts to counteract the weight of the window sash as the sash is opened and closed. One such counterbalancing mechanism is disclosed in U.S. Pat. No. 4,079,549 which shows a biased balance cord connected to the side of a window jamb with a window tilt actuated cam lock for securing the balance to allow removal of the window.

This invention provides for a biased balance cord which extends through a stationary housing member and is connected to a slide block preferably carried by each jamb. The window sash slides vertically between the jambs and is supported by the blocks which slide along with the sash and, in conjunction with the counterbalance, counteract the weight of the sash. The improvement includes a rotative lock pin which extends into each jamb housing member having a balance cord passing through it. The lock pin has a transverse opening through which the balance cord extends. By rotating the lock pin, the balance cord is twisted and the tension in the cord is shifted from the slide block to the stationary jamb housing member. In this manner, the sash can be tilted outwardly of the jambs or removed without the slide blocks springing upward due to a reduction in or entire lack of the sash's balancing weight.

Accordingly, it is an object of this invention to provide for an improved tilt-out window assembly.

Another object is to provide for a tilt-out window assembly which allows for safe and easy cleaning and removal of the window glazing panel.

Another object is to provide for a window assembly with an economical, efficient counterbalancing mechanism.

Other objects will become apparent upon a reading of the following description.

BRIEF DESCRIPTION OF THE DRAWINGS

A preferred embodiment has been chosen to best explain the principles of the invention wherein.

DESCRIPTION OF THE PREFERRED EMBODIMENT

Figure 1:
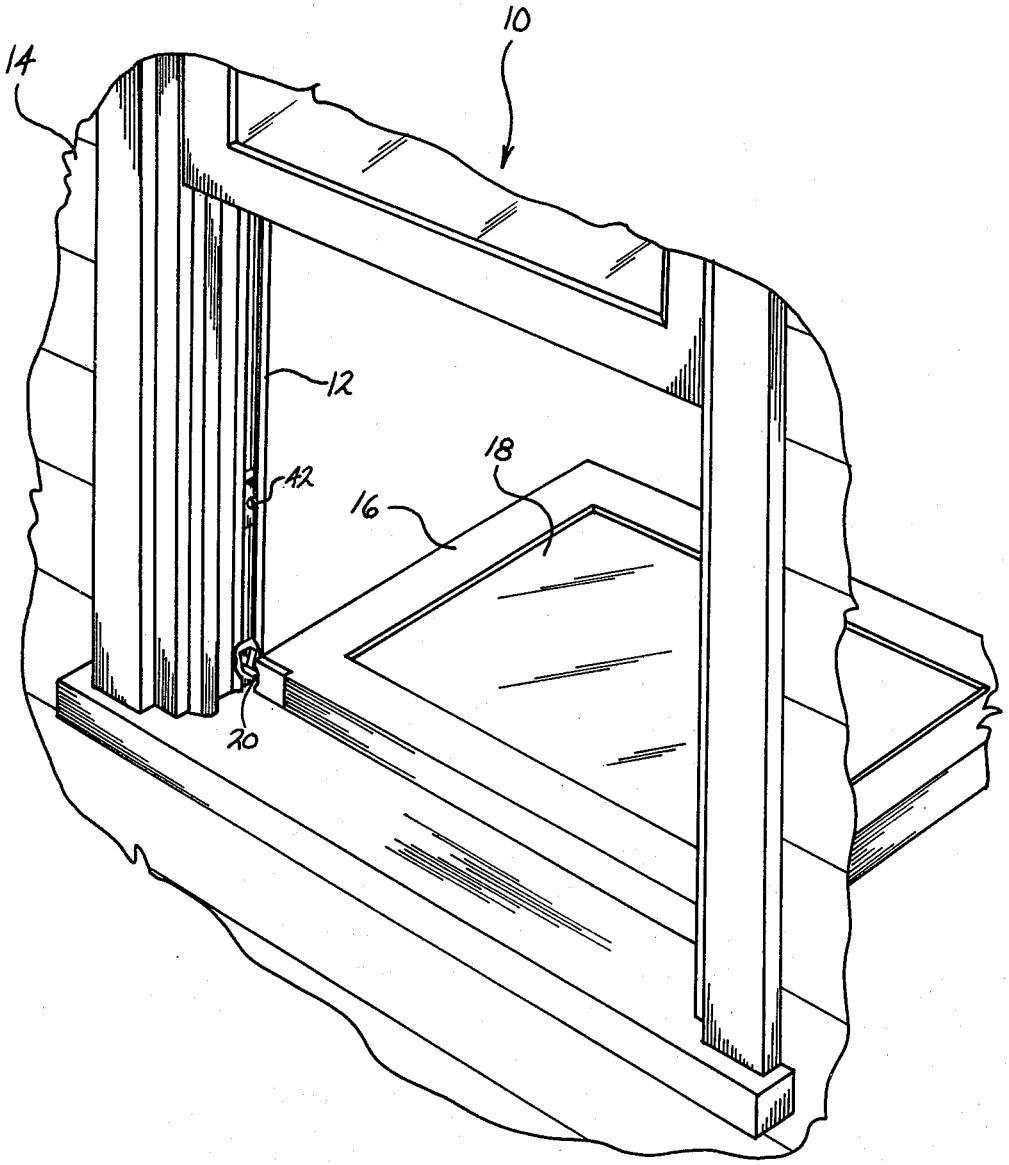
FIG. 1 is a perspective view of a double hung window with one sash in a tilted position.

The preferred embodiment illustrated is not intended to be exhaustive or to limit the invention to the precise form disclosed. It is chosen and described to best explain the principles of the invention and its application and practical use to thereby enable others skilled in the art to best utilize the invention.

The window assembly 10 of this invention includes jamb 12 fitted into a building structure 14. A sash 16 carrying a window glazing panel 18 is slidably fitted between jambs 12. Each outside lower edge of sash 16 includes pin 20 (only one shown) which fits into groove 21 of a block 22 slidably mounted within each jamb 12.

A weight balancing or counterbalancing mechanism 24 is carried within a channel 26 located in jambs 12. There is preferably a counterbalancing mechanism in each jamb 12. Mechanism 24 includes a pulley in conjunction with a helical spring 30 but may be of any standard construction. A balance cord 32 extends downwardly from the pulley and is also enclosed within channel 26. A stationary housing 34 is located within channel 26 of each jamb 12 below mechanism 24 and above slide block 22. A vertical bore 36 extends through housing 34 and cord 32 passes through the bore. The terminal end of cord 32 is attached to the slide block 22. In this construction, block 22 and sash 16 slide vertically within and between jambs 12 with counterbalancing mechanism 24 serving to balance the weight of the sliding sash.

Figure 2:
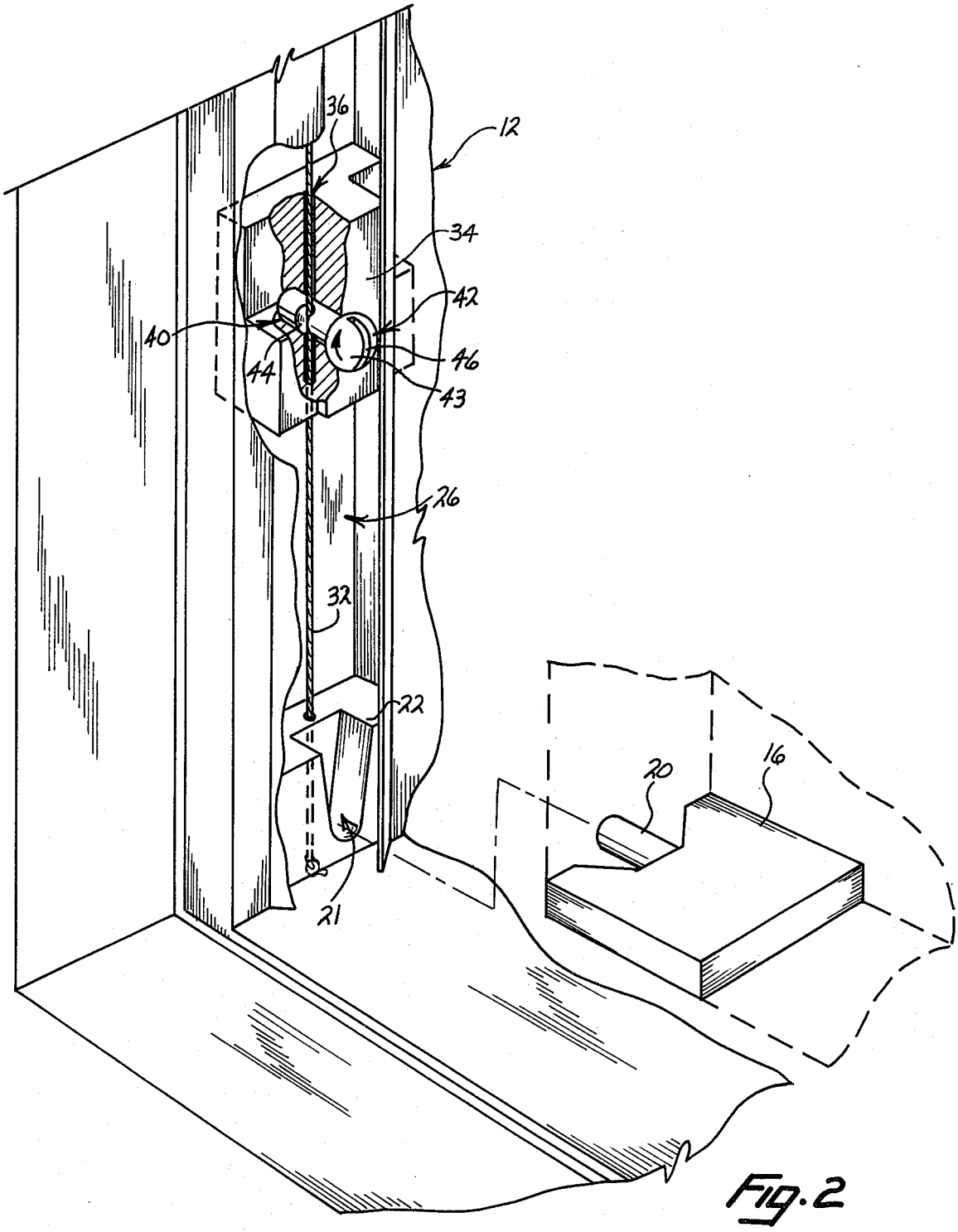
FIG. 2 is a fragmentary perspective view of a window assembly with portions broken away for purposes of illustration.
Figure 3:
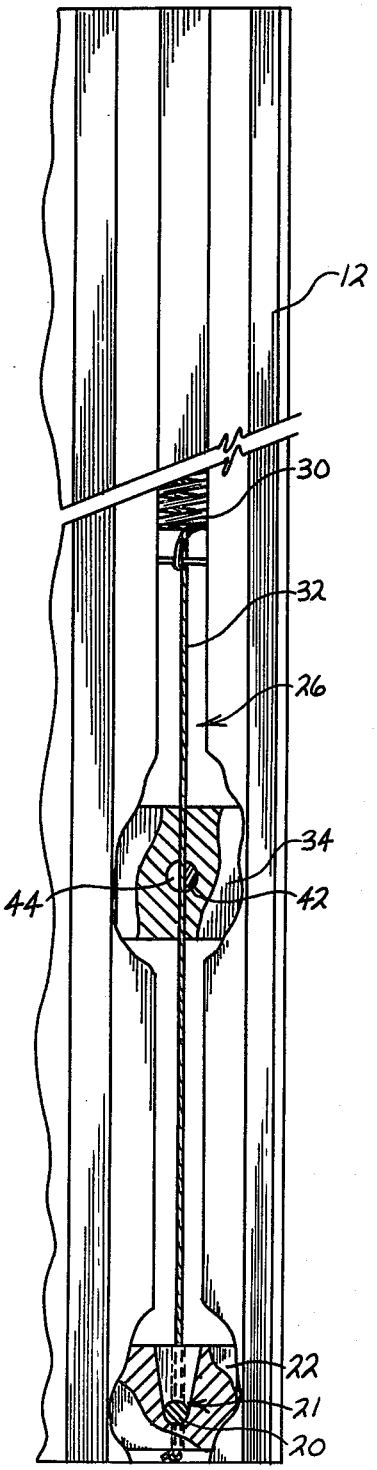
FIG. 3 is a fragmentary side view of a window jamb with portions broken away and sectionalized for purposes of illustration.
Figure 4:
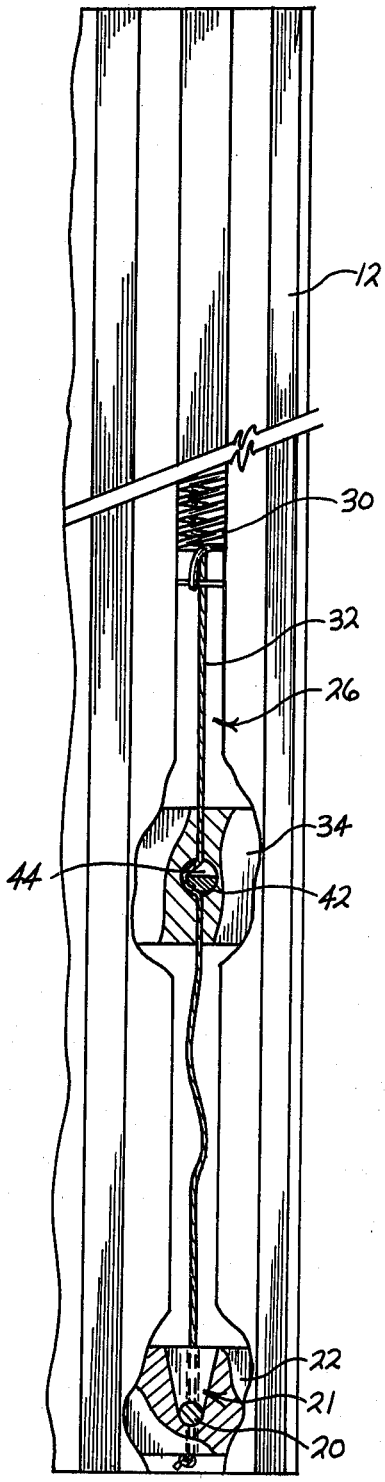
FIG. 4 is a fragmentary side view of a window jamb with the lock pin in a locked position, portions being broken away and sectionalized for purposes of illustration.

Each housing 34 includes a horizontal bore 40 which intersects vertical housing bore 36. A lock pin 42 having a slotted transverse opening 44 in its shank is fitted into each housing bore 40. A balance cord 32 extends through each pin opening 44. The head 43 of each pin 42 is provided with a slot 46 accessible to the window user. Slots 46 allow pins 42 to be rotated by a screw driver when the window assembly 10 is opened as seen in FIG. 1 approximately 90° into a second or cord securing position as shown in FIG. 4. When pin 42 is rotated into its second position, cord 32 is twisted and secured against movement through housing horizontal bore 40, with attached block 22 thereby being freed of the counterbalancing force of mechanism 24. When pin 42 is in its second position, sash 16 may be tilted outwardly of jambs 12 without slide blocks 22 being suddenly raised due to the lessening of downward weight force on the blocks. When pin 42 is in its first position shown in FIGS. 2 and 3, cord 32 extends freely through pin opening 44, and housing 34 under the influence of counterbalance mechanism 24 and exerts a weight balancing force upon attached block 22 and its supported sash 16.

It is to be understood that the above description does not limit the invention to the precise form disclosed and that it may be modified within the scope of the appended claims.

I claim:

1. In a window assembly having a frame including spaced jamb members, a sash carrying a window glazing panel slidably mounted for vertical movement within said jamb members, and a sash weight balancing mechanism carried by at least one of said jamb members, said balancing mechanism including a block shiftable vertically along the one jamb member and a tensioned cord connected to the block, said sash being carried by said block for vertical and tilting movement relative to said one jamb member, said tensioned cord constituting means for balancing the weight of said sash as it slides within said one jamb member, the improvement wherein said one jamb member includes a housing member fixedly located within the one jamb member, said housing member having a vertical bore therethrough and a horizontal bore intersecting the vertical bore, said cord extending through said housing member vertical bore, a rotative lock pin fitted into said housing member horizontal bore and having an opening therethrough alignable with said housing member vertical bore when said pin is in a first rotative position, said pin opening being offset from said housing member vertical bore when the pin is in a second rotative position, said cord extending through said pin opening and being freely shiftable through said housing member horizontal bore and pin opening when the pin is in its first position, said cord being twisted about said pin and secured against movement through said housing member horizontal bore when said pin is in its second position to isolate said block from the weight balancing influence of said weight balancing mechanism, said pin including accessible means for turning the pin between its said first and second rotative positions.

2. The window of claim 1 wherein parts of said jambs are inwardly collapsible, allowing said sash to be tiltable outwardly with respect to said jamb members when the jamb members are collapsed.

3. The window of claim 3 wherein said block includes a generally vertical slot, said sash including a pin means located adjacent the bottom edge of the sash and fitting into said block slot for retaining said sash within said window frame when said jambs are collapsed and said sash is tilted outwardly of said jambs.

* * * * *